US011794945B2

(12) United States Patent
Valencia

(10) Patent No.: US 11,794,945 B2
(45) Date of Patent: Oct. 24, 2023

(54) CONTAINER HAVING LEAK-RESISTANT FOLD-IN TRAY AND BLANK THEREFOR

(71) Applicant: WestRock Shared Services, LLC, Atlanta, GA (US)

(72) Inventor: John Valencia, Johns Creek, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 16/271,988

(22) Filed: Feb. 11, 2019

(65) Prior Publication Data

US 2019/0248537 A1 Aug. 15, 2019

Related U.S. Application Data

(60) Provisional application No. 62/629,908, filed on Feb. 13, 2018.

(51) Int. Cl.

| | |
|---|---|
| ***B65D 5/42*** | (2006.01) |
| ***B65D 5/36*** | (2006.01) |
| ***B65D 5/50*** | (2006.01) |
| ***B31B 50/26*** | (2017.01) |
| ***B31B 50/73*** | (2017.01) |
| *B31B 120/30* | (2017.01) |

(52) U.S. Cl.

CPC ..... *B65D 5/4279* (2013.01); *B31B 50/26* (2017.08); *B31B 50/732* (2017.08); *B65D 5/3657* (2013.01); *B65D 5/4266* (2013.01); *B65D 5/5021* (2013.01); *B31B 2120/302* (2017.08)

(58) Field of Classification Search

CPC ..... B65D 5/5011–5014; B65D 5/5004; B65D 5/5021; B65D 5/48002; B65D 5/667; B65D 5/48014; B65D 5/48016; B65D 5/3614–3628; B65D 5/443; B65D 5/48018

USPC ..... 229/122.32, 172–174, 186, 904, 120.04, 229/120.08, 120.18, 120.03, 120.05, 127, 229/185.1, 183, 117

See application file for complete search history.

(56) References Cited

U.S. PATENT DOCUMENTS

| | | | | |
|---|---|---|---|---|
| 640,818 A * | 1/1900 | Schnackenberg | ..... | B65D 5/643 229/125.38 |
| 1,352,759 A * | 9/1920 | Markert | ..... | B65D 5/5014 229/120.21 |
| 2,670,125 A * | 2/1954 | Frankenstein | ..... | B65D 5/248 206/784 |

(Continued)

FOREIGN PATENT DOCUMENTS

| | | | | |
|---|---|---|---|---|
| DE | 102015001285 A1 * | 8/2016 | ..... | B65D 5/5035 |
| WO | WO-0232770 A2 * | 4/2002 | ..... | B65D 5/2076 |
| WO | WO-2016063249 A1 * | 4/2016 | ..... | B65D 81/263 |

OTHER PUBLICATIONS

Machine Translation of DE 10 2015 001 285 A1 (Year: 2016).*

*Primary Examiner* — Nathan J Newhouse
*Assistant Examiner* — Phillip D Schmidt
(74) *Attorney, Agent, or Firm* — Neil G. Cohen; Brian J. Goldberg

(57) ABSTRACT

A container formed from a blank of sheet material includes an outer tray having a bottom wall, front and rear walls, and first and second side walls. A fold-in tray is configured to nest within the outer tray. The fold-in tray is hingedly connected along an upper edge of at least one of the first side wall, the second side wall, the front wall, and the rear wall.

20 Claims, 5 Drawing Sheets

(56) References Cited

U.S. PATENT DOCUMENTS 4,836,383 A * 6/1989 Gordon ..... B65D 5/48014 219/730
4,957,237 A * 9/1990 Madonna ..... B65D 5/48018 229/120
5,049,710 A * 9/1991 Prosise ..... B65D 81/3453 219/730
5,223,121 A * 6/1993 Dickie ..... B65D 5/5021 206/706
5,335,845 A * 8/1994 Liu ..... B65D 5/48018 229/117.07
5,495,983 A * 3/1996 Lelek ..... B65D 5/48018 229/120.21
5,718,370 A * 2/1998 Lafferty ..... B65D 81/3453 493/110
5,909,840 A * 6/1999 Schultheiss ..... B65D 5/48018 229/172
7,066,321 B2 * 6/2006 Kawaguchi ..... B65D 5/0227 206/499
7,464,855 B2 * 12/2008 Glasgow ..... B65D 5/6626 229/906
7,607,565 B2 * 10/2009 Noguchi ..... B65D 5/6608 206/232
7,661,578 B2 * 2/2010 Li ..... B65D 5/103 229/120.13
7,992,764 B2 * 8/2011 Magnusson ..... B65D 5/48016 229/117
2007/0051785 A1 * 3/2007 Roessiger ..... B65D 5/0227 229/117
2010/0140333 A1 * 6/2010 McDonald ..... B65D 5/6664 220/6
2015/0183548 A1 * 7/2015 Cho ..... B65D 5/546 206/503
2016/0039561 A1 * 2/2016 Stonehouse ..... B65D 5/4295 229/120
2017/0341803 A1 * 11/2017 Marincola ..... B65D 5/4295

* cited by examiner

CONTAINER HAVING LEAK-RESISTANT FOLD-IN TRAY AND BLANK THEREFOR

REFERENCE TO RELATED APPLICATION

This application claims the benefit of priority under 35 U.S.C. § 119(e) of U.S. provisional application Ser. No. 62/629,908 filed on Feb. 13, 2018, which is hereby incorporated by reference in its entirety.

BACKGROUND

The field of the invention relates generally to containers and blanks. More specifically the field of the invention relates to a folded paperboard container or the like and blank therefor having a fold-in tray for providing enhanced leak resistance.

Folded paperboard containers and the like are often used in the fast food industry, among other industries. Advantageously, such containers can be relatively simple and inexpensive to manufacture, ship, assemble, and use. Such containers can be used to contain food products such as chicken nuggets, french fries, hamburgers, etc. Current paperboard containers suffer from certain limitations. In particular, they may be susceptible to leaking moisture out through the container bottom. Accordingly, it is an object of at least one aspect of the present invention to provide a tray and blank therefor that solve or mitigate the problems associated with the prior art.

SUMMARY

According to a first aspect of the invention, there is provided a container formed from a blank of sheet material. The container includes an outer tray having a bottom wall, front and rear walls disposed opposite one another and extending upwardly from respective front and rear edges of the bottom panel, and first and second side walls disposed opposite one another and extending upwardly from respective first and second side edges of the bottom panel. The container also includes a fold-in tray hingedly connected along an upper edge of at least one of the first side wall, the second side wall, the front wall, and the rear wall. The fold-in tray is configured to nest within the outer tray.

The fold-in tray can be hingedly connected along an upper edge of the front wall via a hinged connection. In certain embodiments, the fold-in tray is only connected to the outer tray via the hinged connection.

The fold-in tray can include a tray bottom panel, tray first and second side panels, and tray front and rear panels.

The fold-in tray can include a plurality of corner gussets interconnecting adjacent ones of the tray first side panel, the tray second side panel, the tray front panel, and the tray rear panel.

The fold-in tray can be at least substantially leak-resistant.

The container can include a top closure. The top closure can include a top closure panel hingedly connected along an upper edge of the rear panel and a top tuck flap hingedly connected to the top closure panel.

The bottom wall can include an "auto-bottom"-style bottom closure.

According to a second aspect of the invention, a blank of material for forming a container is provided. The blank includes an outer-tray-forming portion and a fold-in-tray-forming portion. The outer-tray-forming portion is configured to form an outer tray in a set-up container. The outer-tray-forming portion includes a front panel configured to form a front wall of the outer tray in the set-up container, a rear panel configured to form a rear wall of the outer tray in the set-up container, a first side panel configured to form a first side wall of the outer tray in the set-up container, a second side panel configured to form a second side wall of the outer tray in the set-up container, and a bottom-forming portion including at least one bottom panel. The bottom-forming portion is configured to form a bottom wall of the outer tray in the set-up container. The fold-in-tray-forming portion is configured to form a fold-in tray in the set-up container. The fold-in tray is configured to nest within the outer tray in the set-up container. The fold-in-tray-forming portion includes a tray bottom panel configured to form a bottom wall of the fold-in tray in the set-up container, tray first and second side panels configured to form respective first and second side walls of the fold-in tray in the set-up container, and tray front and rear panels configured to form respective front and rear walls of the fold-in tray in the set-up container. The tray front panel is hingedly connected to the front panel along an upper edge of the front panel.

The tray front panel can be hingedly connected to the front panel along an upper edge of the front panel. In certain embodiments, the fold-in-tray-forming portion is only connected to the outer-tray-forming portion via the hinged connection.

The fold-in-tray-forming portion can further include a plurality of corner gussets interconnecting adjacent ones of the tray first side panel, the tray second side panel, the tray front panel, and the tray rear panel.

The fold-in tray can be at least substantially leak resistant.

The blank can further include a top closure panel hingedly connected along an upper edge of the rear panel and a top tuck flap hingedly connected to the top closure panel. The top closure panel and top tuck flap can be configured to form a top closure of the outer tray in the set-up container.

The at least one bottom panel can include first and second bottom panels. The bottom-forming portion can further include first and second bottom flaps. The first and second bottom panels and first and second bottom flaps can be configured to form an "auto-bottom"-style closure in the set-up container.

BRIEF DESCRIPTION OF THE DRAWINGS

Exemplary embodiments of the invention will now be described with reference to the accompanying drawings, in which.

DETAILED DESCRIPTION

Detailed descriptions of specific embodiments of cartons and blanks are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the cartons and blanks described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the term "container" or "carton" refers, for the non-limiting purpose of illustrating the various features of the invention, to a container for transporting, storing, and/or dispensing articles. It is contemplated that the teachings of the invention can be applied to various containers suitable for carrying a wide variety of articles.

Figure 1:
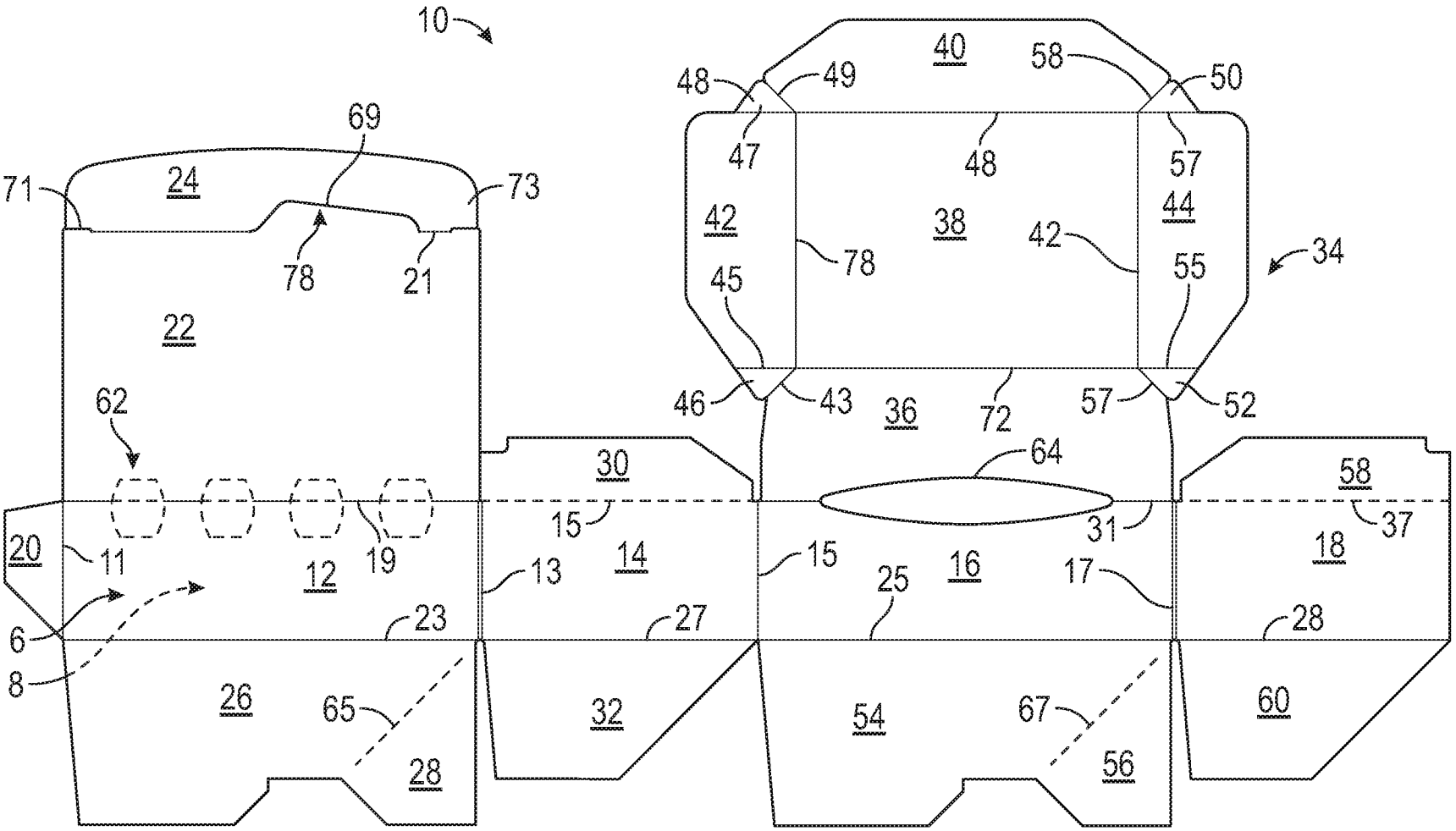
FIG. 1 is a top plan view of an exemplary blank of sheet material according to a first embodiment of the invention.
Figure 2:
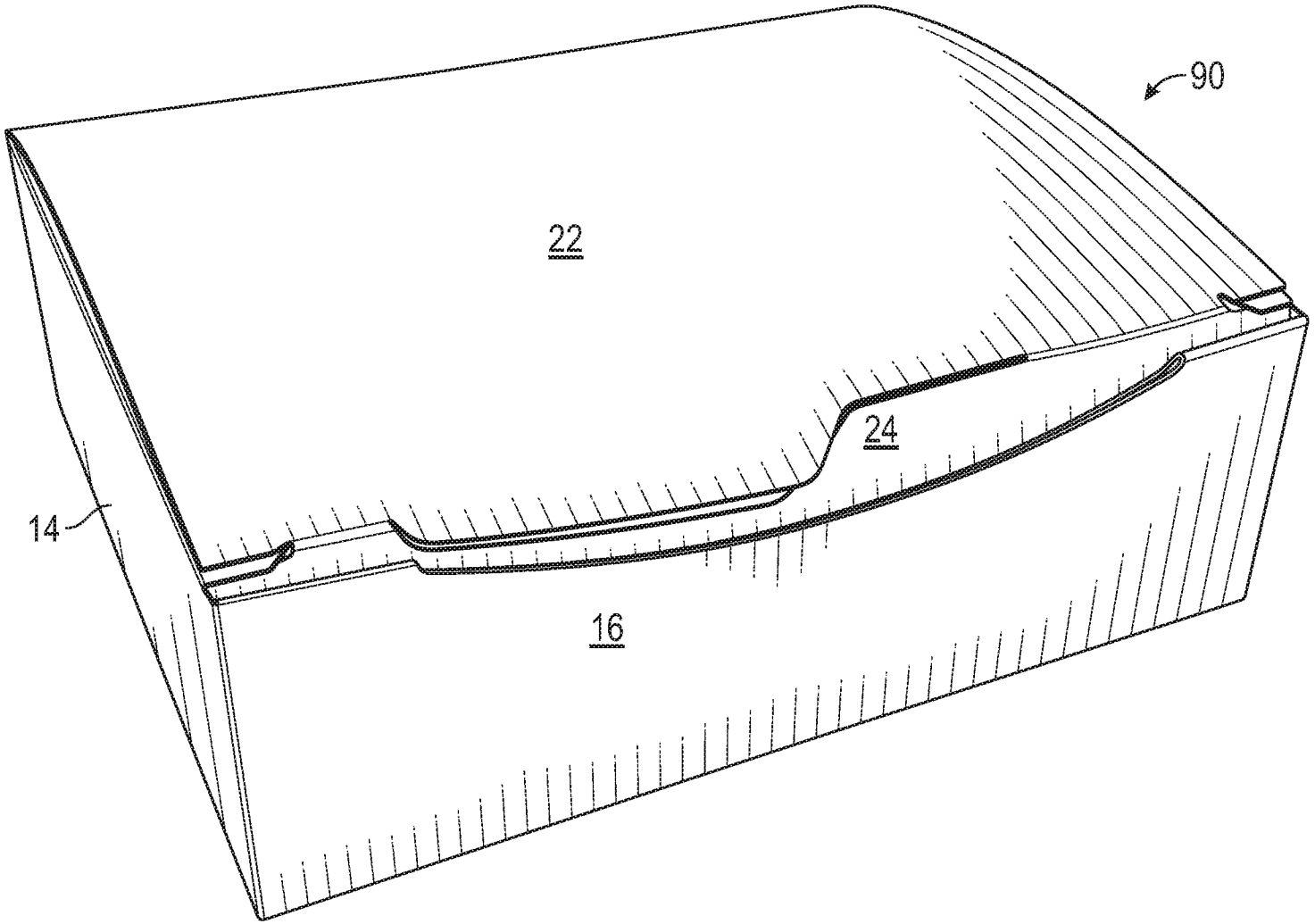
FIG. 2 is a perspective view of a carton formed from the blank of FIG. 1 with its lid in a closed configuration.
Figure 3:
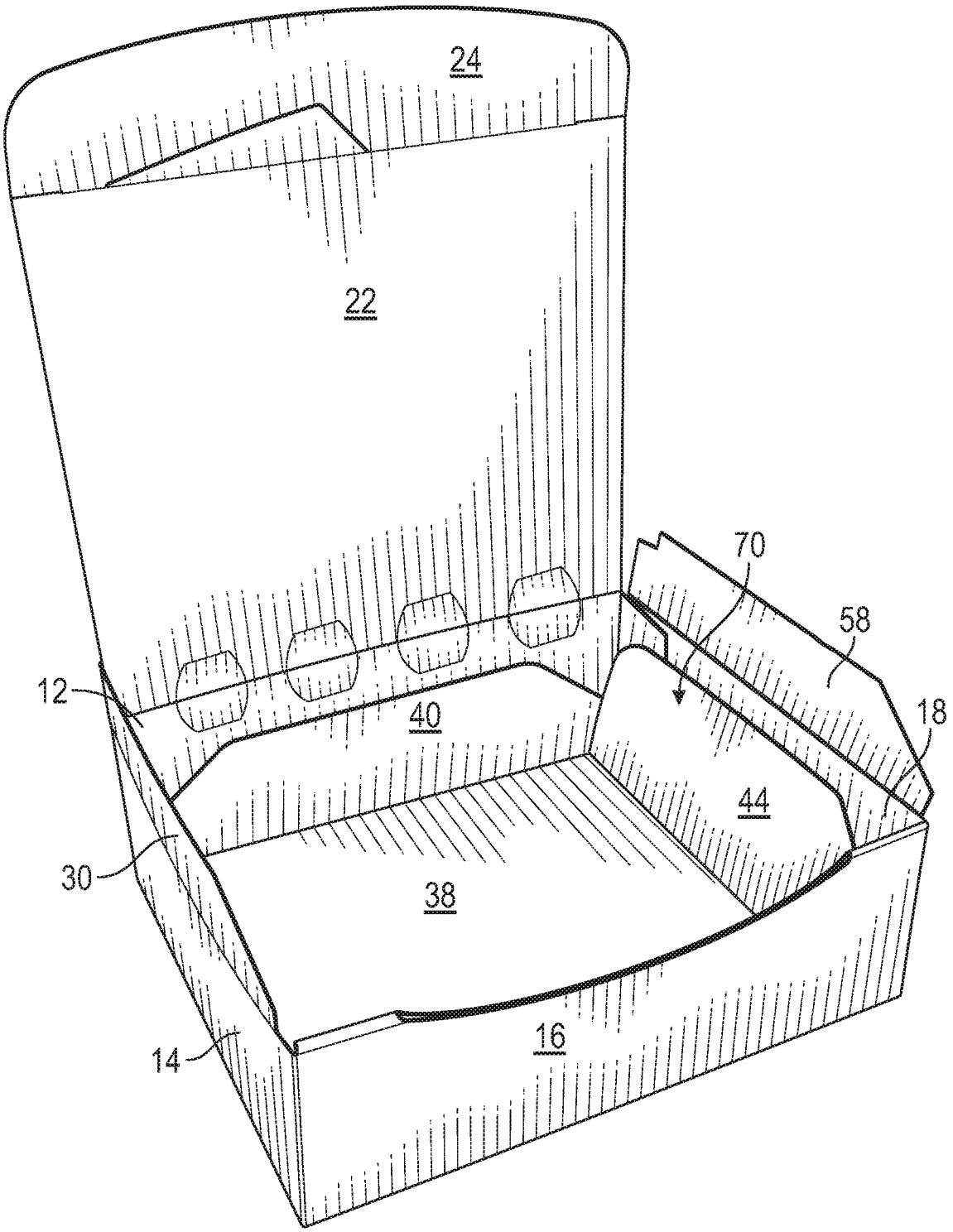
FIG. 3 is a perspective view of the carton of FIG. 2 with its lid in an open configuration.

Referring to FIG. 1, there is shown a first blank 10 for forming a carton 90 (see FIGS. 2-3). The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the cartons described in more detail below.

In one or more embodiments, blank 10 can be formed from a paperboard, corrugated board, or cardboard in which one or both sides of the blank, is printed and/or treated with one or more coatings, such as for example, one or more waterproof coatings and/or one or more coatings designed to provide a smooth and/or visually-attractive surface (e.g., a white or other colored surface). In one or more embodiments, informational or promotional material such as, e.g., a brand name or logo, can be printed on a treated side.

Referring to FIG. 1, blank 10 has a first or exterior surface 6 and a second or interior surface 8. Blank 10 includes a plurality of panels hingedly connected together in series that form a tubular structure in the erected carton 90. A glue flap panel 20 is hingedly connected to a rear panel 12 via transverse fold line 11. Rear panel 12 is hingedly connected to a first side panel 14 via transverse fold line 13. First side panel 14 is hingedly connected to a front panel 16 via transverse fold line 15. Front panel 16 is hingedly connected to a second side panel 18 via transverse fold line 17.

A first bottom closure panel 26 is hingedly connected to rear panel 12 along a lower end thereof via longitudinal fold line 23. A first bottom closure flap 32 is hingedly connected to first side panel 14 along a lower end thereof via longitudinal fold line 27. A second bottom closure panel 54 is hingedly connected to front panel 16 along a lower end thereof via longitudinal fold line 29. A second bottom closure flap 60 is hingedly connected to second side panel 18 along a lower end thereof via longitudinal fold line 35. Oblique fold lines 65, 67 can be formed in respective first and second bottom closure panels 26, 54, defining respective hinged sections 28 and 56. In the illustrated embodiment, bottom closure panels and flaps 26, 32, 54, 60 are configured so as to form an "auto-bottom"-style bottom closure of carton 90 in which a bottom wall 87 of the carton 90 is automatically formed as the carton is erected into a tubular form. In other embodiments, however, other style bottom closures may be used. Bottom wall 87, together with front panel 16, rear panel 12, first side panel 14, and second side panel 18, form an outer tray portion 89 of carton 90.

A top closure panel 22 is hingedly connected to rear panel 12 along an upper end thereof via longitudinal fold line 19. In the illustrated embodiment, longitudinal fold line 19 is interrupted by a plurality of depressible menu tabs 62. A top tuck flap 24 is hingedly connected to top closure panel 22 along an upper end thereof via longitudinal fold line 21. Cut lines 71 and 73 extend from opposite edges of fold line 21 to opposite outer edges of top tuck flap 24. A cut line 69 interrupts fold line 21 and defines a tab 78 that facilitates opening of the carton 90. A first dust flap 30 is hingedly connected to first side panel 14 along an upper edge thereof via longitudinal fold line 25. A second dust flap 58 is hingedly connected to second side panel 18 along an upper edge thereof via longitudinal fold line 33. Top closure panel 22, top tuck flap 24, and first and second dust flaps 30, 58 are configured to form a slit lock tuck-style top closure or lid of carton 90. In other embodiments, however, other style top closures may be used.

Blank 10 includes a fold-in-tray-forming portion 34 that includes a tray front panel 36, tray base panel 38, tray rear panel 40, tray first side panel 42, and tray second side panel 44, as well as first, second, third, and fourth corner gusset panels 46, 48, 50, 52. Tray front panel 36 is hingedly connected to front panel 16 along an upper end thereof via longitudinal fold line 31. In the illustrated embodiment, fold line 31 is interrupted by an aperture 64. A tray base panel 38 is hingedly connected to front tray panel 36 along an upper end thereof via longitudinal fold line 37. A tray rear panel 40 is hingedly connected to tray base panel 38 along an upper end thereof via longitudinal fold line 43. A tray first side panel 42 is hingedly connected to base panel 38 along a first side thereof via transverse fold line 39. A tray second side panel 44 is hingedly connected to base panel 38 along a second side thereof via transverse fold line 41. A first corner gusset panel 46 is disposed between and hingedly connected to tray first side panel 42 and tray front panel 36 along respective fold lines 45 and 43. A second corner gusset panel 48 is disposed between and hingedly connected to tray first side panel 42 and tray rear panel 40 along respective fold lines 47 and 49. A third corner gusset panel 50 is disposed between and hingedly connected to tray rear panel 40 and tray second side panel 44 along respective fold lines 51 and 53. A fourth corner gusset panel 52 is disposed between and hingedly connected to tray second side panel 44 and tray front panel 36 along respective fold lines 55 and 57. Tray front panel 36, tray rear panel 40, tray first side panel 42, tray second side panel 44, and first, second, third, and fourth gusset panels 46, 48, 50, 52 together form a leak-resistant fold-in tray 70 in the erected carton 90 as shown in FIG. 3. Fold-in tray 70 is preferably sized and configured to nest within carton 90 so as to generally conform to outer tray portion 89. Thus, in the erected carton, tray base panel 38 may overlie and rest in a flat, generally face-contacting relationship with carton bottom wall 87; tray front panel 36 may overlie and rest in a flat, generally face-contacting relationship with front panel 16; tray rear panel 40 may overlie and rest in a flat, generally face-contacting relationship with rear panel 12; tray first side panel 42 may overlie and rest in a flat, generally face-contacting relationship with first side panel 14; and tray second side panel 44 may overlie and rest in a flat, generally face-contacting relationship with second side panel 18. It is noted that in the illustrated embodiment, fold-in-tray-forming portion 34 is only attached to the outer-tray-forming portion of blank 10 via the hinged connection (fold line 31) between tray front panel 36 and front panel 16.

Figure 4:
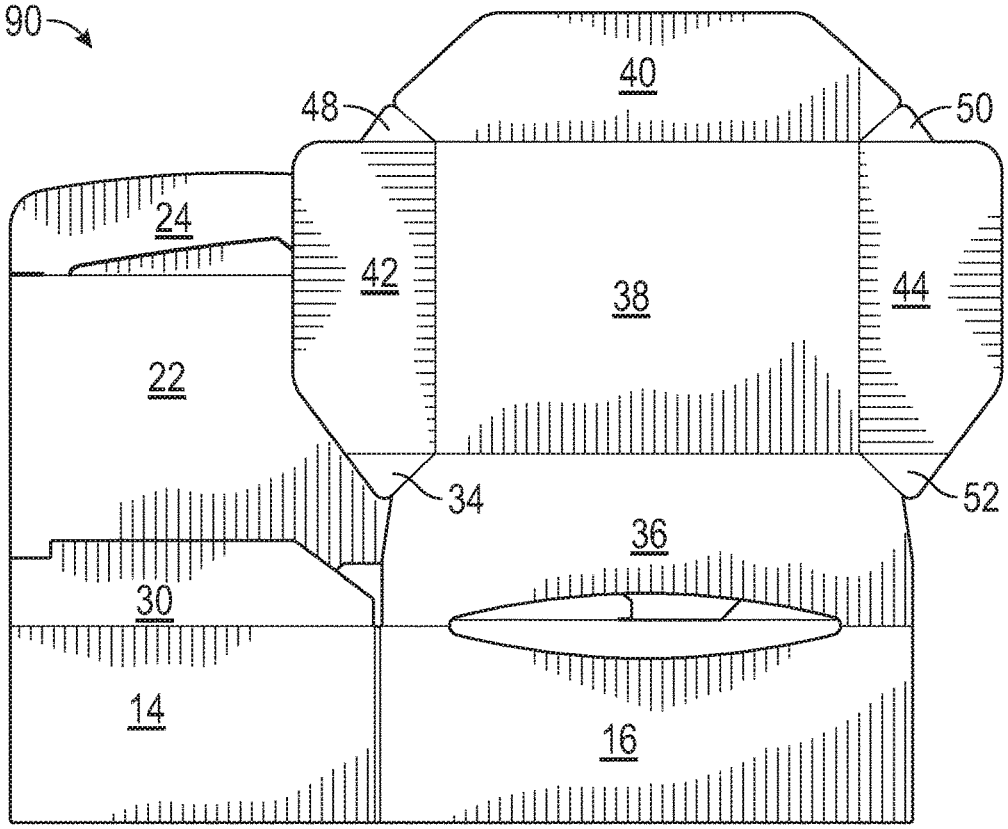
FIGS. 4-7 show various steps in the construction of the carton of FIG. 2.
Figure 5:
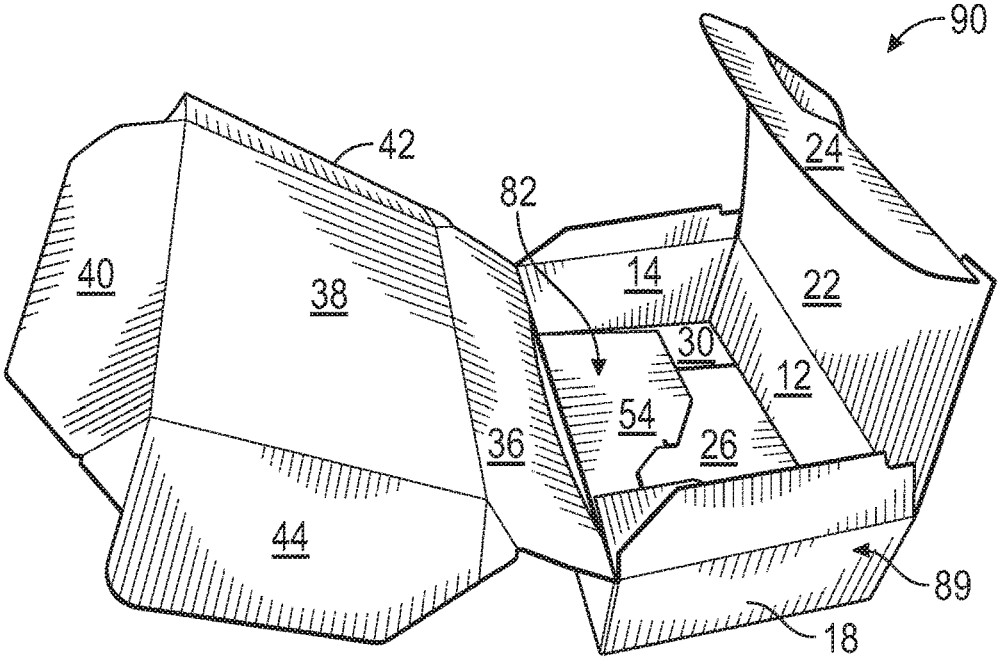
Figure 6:
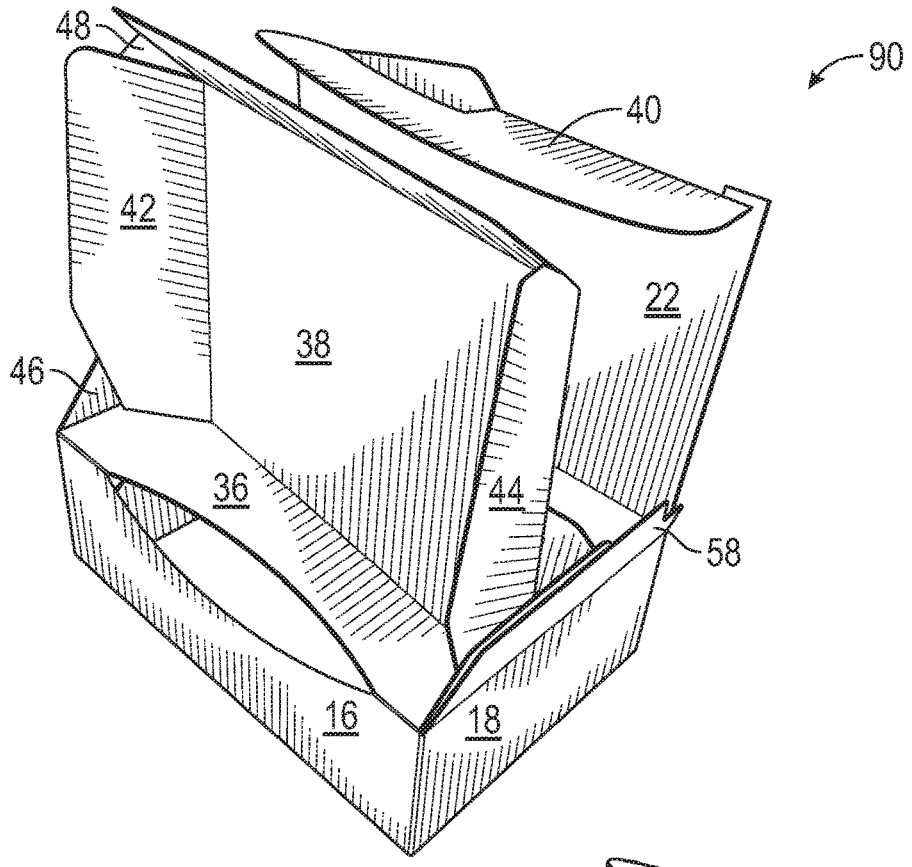
Figure 7:
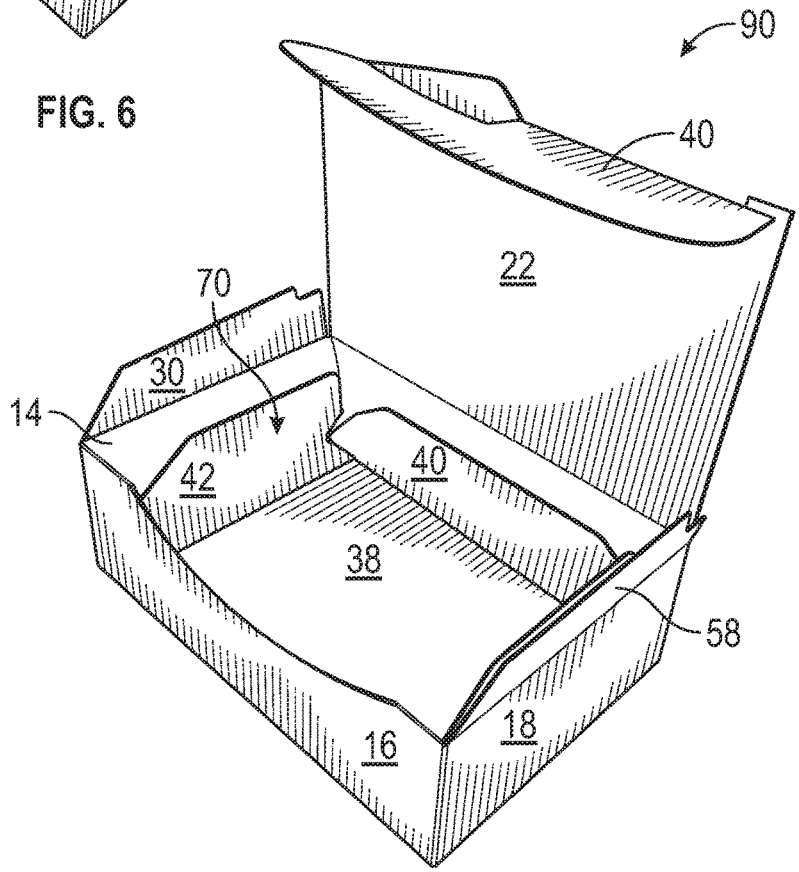

Turning to the construction of the carton 90 as illustrated in FIG. 2, the carton 90 is configured so that it can be quickly hand erected from a knocked-down-flat configuration. Blank 10 can be assembled into the knocked-down flat configuration shown in FIG. 4 by adhering glue flap 20 to second side panel 18 to form a collapsed tubular structure and by folding bottom closure panels and flaps 26, 32, 54, 60 to form the carton's auto-erecting bottom closure. To erect the carton 90, a user can move, for example, rear panel 12 relative to front panel 16 until they are substantially aligned with one another in a tubular container structure, resulting in the partially-formed carton shown in FIG. 5. Fold-in tray 70 can then be formed very quickly and essentially "automatically" by simply folding tray front panel 36 inwardly along fold line 31 (as shown in FIG. 6) and "tucking" the components of tray-forming portion 34 into the interior of outer tray portion 89. Fold-in tray 70 is formed automatically via this tucking motion as the fold-in tray components are brought into contact with, and folded by so as to generally contour to, their counterparts. This results in the erected carton 90 with open top closure as shown in FIG. 70. Dust flaps 30, 58, top closure panel 22, and top tuck flap 24 can be folded inwardly along their respective fold lines to close the carton's top, resulting in the closed carton 90 shown in FIG. 2.

The configuration of the disclosed blank 10 and carton 90 may provide certain advantages over cartons. In particular, the blank 10 is straightforward and inexpensive to manufacture. The carton 90 can be shipped in a knocked-down-flat configuration and then quickly and easily erected on site. The fold-in tray 34 provides a leak-resistant barrier that is integrally formed with the container and thus reliably positioned within the outer tray. In addition, carton 90 may provide enhanced thermal retention properties. As yet another potential advantage, the effectively 2-ply nature of the carton bottom created by the overlap of the tray base and carton bottom wall may significantly reduce the issue of grease wicking. This may reduce the issue of oil stains and enable the carton to be manufactured without a coating/barrier, thereby reducing the cost of manufacture and enhancing the recyclability/compostability of the carton.

Exemplary embodiments of blanks and methods for forming containers are described above in detail. The apparatus and methods are not limited to the specific embodiments described herein, but rather, components of apparatus and/or steps of the methods may be utilized independently and separately from other components and/or steps described herein. For example, in the illustrated embodiment, fold-in-tray-forming portion 34 is hingedly connected to the remainder of the blank 10 along an upper edge of front panel 16. In other embodiments, however, a fold-in-tray-forming portion can be hingedly connected to the remainder of the blank 10 along an upper edge of the rear panel, first side panel, or second side panel.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container formed from a blank of sheet material, the container comprising: an outer tray comprising a plurality of walls including a bottom wall, front and rear walls disposed opposite one another and extending upwardly from respective front and rear edges of the bottom wall, and first and second side walls disposed opposite one another and extending upwardly from respective first and second side edges of the bottom wall; a fold-in tray hingedly connected along at least a portion of an upper edge of at least one connected wall, wherein the at least one connected wall comprises one or more of said first side wall, said second side wall, and said front wall, the fold-in tray configured to nest in a nested position within the outer tray such that, in the nested position, a tray bottom panel opposes the bottom wall of the outer tray and is adjacent to the bottom wall of the outer tray, along substantially an entire area of the tray bottom panel, at least one other tray panel extends upwardly from an edge of the tray bottom, and an additional tray panel extends: (i) upwardly from an opposite edge of the tray bottom panel that is opposite the at least one other tray panel and (ii) adjacent to one of the plurality of walls of the outer tray that is opposite the at least one connected wall, wherein the fold-in tray is at least leak resistant via corner gusset structures; and a top closure, the top closure comprising a top closure panel hingedly connected along an upper edge of the rear wall and separate from the fold-in tray.

2. The container according to claim 1, wherein the fold-in tray is hingedly connected along an upper edge of the front wall via a hinged connection, and wherein said fold-in tray is only connected to said outer tray via said hinged connection.

3. The container according to claim 2, wherein the hinged connection is formed by a single fold line and wherein the single fold line is interrupted by an aperture.

4. The container according to claim 1, wherein the fold-in tray comprises the tray bottom panel, a tray first side panel, a tray second side panel, a tray front panel, and a tray rear panel, wherein the one other tray panel comprises one of: the tray first side panel, the tray second side panel, the tray front panel, and the tray rear panel, and wherein the additional tray panel comprises a different one of: the tray first side panel, the tray second side panel, the tray front panel, and the tray rear panel, and wherein, in the nested position, the tray first side panel overlies and is adjacent to the first side wall of the outer tray, the tray second side panel overlies and is adjacent to the second side wall of the outer tray, the tray front panel overlies and is adjacent to the front wall of the outer tray, and the tray rear panel overlies and is adjacent to the rear wall of the outer tray.

5. The container according to claim 4, wherein, in the nested position, the tray first side panel extends upwardly from a first side edge of the tray bottom panel and opposes the first side wall so as to be in at least partial face-contacting relationship with the first side wall, the tray second side panel extends upwardly from a second side edge of the tray bottom panel and opposes the second side wall so as to be in at least partial face-contacting relationship with the second side wall, the tray front panel extends upwardly from a front edge of the tray bottom panel and opposes the front wall, and the tray rear panel extends upwardly from a rear edge of the tray bottom panel and opposes the rear wall.

6. The container according to claim 1, wherein the fold-in tray comprises the tray bottom panel, a tray first side panel, a tray second side panel, a tray front panel, and a tray rear panel, wherein the one other tray panel comprises one of: the tray first side panel, the tray second side panel, the tray front panel, and the tray rear panel, and wherein the additional tray panel comprises a different one of: the tray first side panel, the tray second side panel, the tray front panel, and the tray rear panel, and wherein the corner gusset structures of the fold-in tray comprises a plurality of corner gussets, each interconnecting adjacent ones of the tray first side panel, the tray second side panel, the tray front panel, and the tray rear panel, respectively, without adhesive.

7. The container according to claim 1, wherein the fold-in tray comprises the tray bottom panel, a tray first side panel, a tray second side panel, a tray front panel, and a tray rear panel, wherein the one other tray panel comprises one of: the tray first side panel, the tray second side panel, the tray front panel, and the tray rear panel, and wherein the additional tray panel comprises a different one of: the tray first side panel, the tray second side panel, the tray front panel, and the tray rear panel, and wherein the corner gusset structures of the fold-in tray comprises a plurality of corner gussets interconnecting adjacent ones of the tray first side panel, the tray second side panel, the tray front panel, and the tray rear panel, and wherein the plurality of corner gussets comprise a first corner gusset panel disposed between and hingedly connected to the tray first side panel and to the tray front panel along respective fold lines, a second corner gusset panel disposed between and hingedly connected to the tray first side panel and to the tray rear panel along respective fold lines, a third corner gusset panel disposed between and hingedly connected to the tray rear panel and to the tray second side panel along respective fold lines, and a fourth corner gusset panel disposed between and hingedly connected to the tray second side panel and to the tray front panel along respective fold lines.

8. The container according to claim 1, wherein the top closure comprises a top tuck flap hingedly connected to the top closure panel, the top tuck flap configured to tuck into an interior space of the container adjacent the front wall.

9. The container according to claim 1, wherein the bottom wall comprises at least two bottom panels configured such that the bottom wall is automatically formed as the container is formed from the blank.

10. The container according to claim 1, wherein, in the nested position, the tray bottom panel overlies the bottom wall and at least a portion of the tray bottom panel abuts the bottom wall.

11. The container according to claim 1, wherein, in the nested position, an upper edge of the one other tray panel is disposed a distance vertically from the upper edge of the connected wall.

12. A blank of sheet material for forming a container, the blank comprising:

an outer-tray-forming portion configured to form an outer tray in a set-up container, the outer-tray-forming portion comprising a plurality of panels including a front panel configured to form a front wall of the outer tray in the set-up container, a rear panel configured to form a rear wall of the outer tray in the set-up container, a first side panel configured to form a first side wall of the outer tray in the set-up container, a second side panel configured to form a second side wall of the outer tray in the set-up container, and a bottom-forming portion comprising at least one bottom panel, the bottom-forming portion configured to form a bottom wall of the outer tray in the set-up container;

a fold-in-tray-forming portion configured to form a fold-in tray in the set-up container, the fold-in-tray-forming portion comprising a tray bottom panel and at least one other tray panel, wherein the fold-in-tray-forming portion is hingedly connected along at least a portion of an edge of at least one connected panel, wherein the at least one connected panel comprises one or more of the first side panel, the second side panel, and the front panel, wherein the fold-in tray is configured to nest in a nested position within the outer tray in the set-up container such that, in the nested position, the tray bottom panel opposes the bottom wall of the outer tray and is adjacent to the bottom wall of the outer tray, and the at least one other tray panel is configured to extend upwardly from an edge of the tray bottom panel, and an additional tray panel is configured to extend upwardly from an edge of the tray bottom panel opposite the at least one other tray panel and adjacent to one of the plurality of panels of the outer-tray-forming portion that is opposite the at least one connected panel, wherein the fold-in-tray-forming portion is configured to form the fold-in tray in the set-up container such that the fold-in tray is at least leak resistant via corner gusset structures of the fold-in-tray-forming portion; and a top closure, the top closure comprising a top closure panel hingedly connected along an upper edge of the rear wall and separate from the fold-in tray.

13. The blank according to claim 12, wherein the fold-in-tray-forming portion is hingedly connected to the front panel along an upper edge of the front panel via a hinged connection, and wherein said fold-in-tray-forming portion is only connected to said outer-tray-forming portion via said hinged connection.

14. The blank according to claim 12, wherein the fold-in-tray-forming portion comprises a tray bottom panel configured to form a bottom wall of the fold-in tray in the set-up container, a tray first side panel and a tray second side panel configured to form respective first and second side walls of the fold-in tray in the set-up container, and a tray front panel and a tray rear panel configured to form respective front and rear walls of the fold-in tray in the set-up container, wherein the at least one other tray panel comprises at least one of: the tray first side panel, the tray second side panel, the tray front panel, and the tray rear panel, and wherein the additional tray panel comprises a different one of: the tray first side panel, the tray second side panel, the tray front panel, and the tray rear panel, and wherein the corner gusset structures of the fold-in-tray-forming portion comprises a plurality of corner gussets, each interconnecting adjacent ones of the tray first side panel, the tray second side panel, the tray front panel, and the tray rear panel, respectively, without adhesive.

15. The blank according to claim 12, wherein the fold-in-tray-forming portion comprises a tray bottom panel configured to form a bottom wall of the fold-in tray in the set-up container, a tray first side panel and a tray second side panel configured to form respective first and second side walls of the fold-in tray in the set-up container, and a tray front panel and a tray rear panel configured to form respective front and rear walls of the fold-in tray in the set-up container, wherein the at least one other tray panel comprises at least one of: the tray first side panel, the tray second side panel, the tray front panel, and the tray rear panel, and wherein the additional tray panel comprises a different one of: the tray first side panel, the tray second side panel, the tray front panel, and the tray rear panel, and wherein the corner gusset structures of the fold-in-tray-forming portion comprises a plurality of corner gussets interconnecting adjacent ones of the tray first side panel, the tray second side panel, the tray front panel, and the tray rear panel, and wherein the plurality of corner gussets comprise a first corner gusset panel disposed between and hingedly connected to the tray first side panel and to the tray front panel along respective fold lines, a second corner gusset panel disposed between and hingedly connected to the tray first side panel and to the tray rear panel along respective fold lines, a third corner gusset panel disposed between and hingedly connected to the tray rear panel and to the tray second side panel along respective fold lines, and a fourth corner gusset panel disposed between and hingedly connected to the tray second side panel and to the tray front panel along respective fold lines.

16. The blank according to claim 12, further comprising a top tuck flap hingedly connected to the top closure panel via a longitudinal fold line, the longitudinal fold line being interrupted by a cut line that defines a tab.

17. The blank according to claim 12, wherein the at least one bottom panel comprises first and second bottom panels, and wherein the bottom-forming portion further comprises first and second bottom flaps, the first and second bottom panels and first and second bottom flaps being configured to automatically form the bottom wall of the outer tray as the container is erected into its set-up form.

18. The blank according to claim 12, wherein the fold-in-tray-forming portion comprises a tray bottom panel configured to form a bottom wall of the fold-in tray in the set-up container, a tray first side panel and a tray second side panel configured to form respective first and second side walls of the fold-in tray in the set-up container, and a tray front panel and a tray rear panel configured to form respective front and rear walls of the fold-in tray in the set-up container, wherein the tray front panel is hingedly connected to the front panel along an edge of the front panel, wherein the at least one other tray panel comprises at least one of: the tray first side panel, the tray second side panel, the tray front panel, and the tray rear panel, and wherein the additional tray panel comprises a different one of: the tray first side panel, the tray second side panel, the tray front panel, and the tray rear panel.

19. The blank according to claim 12, further comprising a glue flap hingedly connected to at least one of the front panel, the rear panel, the first side panel, and the second side panel, wherein the glue flap is configured to adhere to another of the front panel, the rear panel, the first side panel, or the second side panel via an adhesive.

20. The blank according to claim 12, wherein the front panel is hingedly connected to the first side panel and hingedly connected to the second side panel, and at least one of the first side panel and the second side panel is hingedly connected to a bottom panel of the bottom-forming portion, and wherein the tray front panel is hingedly connected directly to the front panel via a fold line along an edge of the front panel.

* * * * *